United States Patent [19]

Lane

[11] Patent Number: 4,921,238

[45] Date of Patent: May 1, 1990

[54] SHEET FEEDER HAVING PREACTUATED PICKER ROLLER

[75] Inventor: Donald Lane, Trevose, Pa.

[73] Assignee: Brandt, Inc., Bensalem, Pa.

[21] Appl. No.: 271,901

[22] Filed: Nov. 15, 1988

[51] Int. Cl.[5] ..... B65H 1/22

[52] U.S. Cl. ..... 271/37; 271/122; 271/114

[58] Field of Search ..... 271/114, 116, 121, 122, 271/270, 10, 37, 38, 258, 265

[56] References Cited

U.S. PATENT DOCUMENTS 3,937,455 2/1976 Hauser ..... 271/122

4,474,365 10/1984 DiBlasio ..... 271/3

4,560,154 12/1985 Nogi et al. ..... 271/116

4,615,518 10/1986 DiBlasio ..... 271/121

*Primary Examiner*—H. Grant Skaggs

*Attorney, Agent, or Firm*—Shenier & O'Connor

[57] ABSTRACT

A sheet feeder in which a picker member engaging an end sheet of a stack is actuated to drive the end sheet through a feed nip formed by a feed member and a cooperating member. The picker member is actuated in advance of the feed member to prevent other sheets from entering the nip. Preferably, the picker member is preactuated by coupling it directly to the drive source while coupling the feed member to the same drive source through an electrically actuated clutch.

9 Claims, 3 Drawing Sheets

SHEET FEEDER HAVING PREACTUATED PICKER ROLLER

BACKGROUND OF THE INVENTION

This invention relates to apparatus for feeding sheets and, more particularly, to apparatus for feeding documents such as currency, checks, food stamps or the like in counting, batching or other operations.

BACKGROUND OF THE INVENTION

Document handlers for counting, batching or performing other operations on currency, checks, food stamps or other documents are well known in the art. Apparatus of this type is shown, for example, in Di-Blasio U.S. Pat. Nos. 4,474,365 and 4,615,518. Typically, in such document handlers, sheets are placed in an input tray inclined upwardly away from a feed nip formed by one or more feed rollers and stripper members disposed above the feed rollers. One or more picker rollers engage the lowermost sheet at a location spaced upstream from the feed rollers. To advance a sheet from the stack, the feed rollers are driven along with the picker rollers to advance the sheet through the nip. One problem encountered in the operation of feeders of this type is that sheets toward the top of the stack, which are also biased into the feed nip, may erroneously be drawn into the nip, causing misfeed.

SUMMARY OF THE INVENTION

One object of my invention is to provide a sheet feeder which reduces the chances of misfeed.

Another object of my invention is to provide a sheet feeder which minimizes the tendency for other sheets to pass through the feed nip along with the sheet being fed.

Other and further objects will become apparent from the following description.

In general, my invention contemplates a sheet feeder in which the actuation of the feed member is delayed until after the actuation of the picker member or, equivalently, in which the picker member is actuated in advance of the feed member. Preferably, this is accomplished by coupling the feed member to the drive source through an electrically actuated clutch while coupling the picker member to the same drive source directly, independently of the clutch. Since the picker member acts only on the end sheet of the stack (the lowermost sheet in the feeder described above), the end sheet receives an advance nudge into the feed nip which the other sheets do not. As a result, misfeeds of the type described above are significantly reduced.

BRIEF DESCRIPTION OF THE DRAWINGS

In the accompanying drawings to which reference is made in the instant specification and which are to be read in conjunction therewith and in which like reference numerals are used to indicate like parts in the various views.

DESCRIPTION OF THE PREFERRED EMBODIMENT

Figure 1:
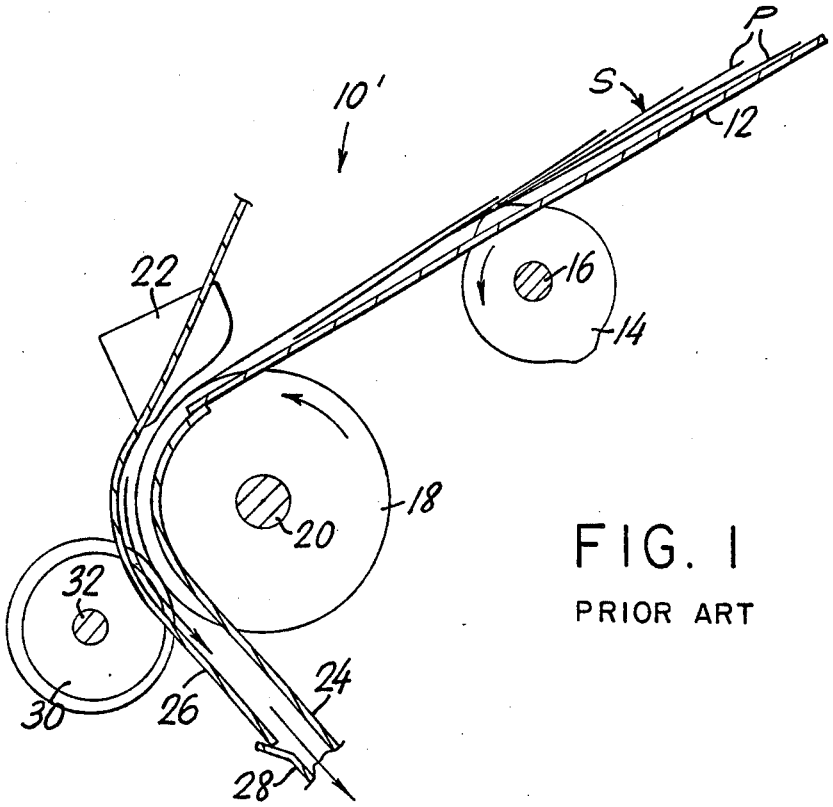
FIG. 1 PRIOR ART
FIG. 1 is a section of an existing sheet feeder illustrating a type of misfeed to which it is susceptible

Referring now to FIG. 1, an existing form of sheet feeder, indicated generally by the reference numeral 10', includes an input tray 12 for supporting a stack S of sheets of paper P, which may typically be currency, checks, food stamps or the like. Tray 12 is inclined upwardly toward the front of the feeder 10,, to the right in FIG. 1, to bias the stack S into the feed nip formed by a pair of transversely spaced feed rollers 18 carried by a shaft 20 and respective stripper members 22 disposed opposite feed rollers 18. A pair of transversely spaced picker rollers 14 supported on a shaft 16 are formed with lobes that extend upwardly through slots (not shown) in tray 12 to urge the bottom sheet P into the feed nip formed by feed rollers 18 and stripper members 22.

Stripper members 22 have a coefficient of friction with sheets P that is greater than that between two successive sheets but less than the coefficient of friction between a sheet and the feed rollers 18. Accordingly, if the feeder 10' is operating properly, feed rollers 18 drive the bottom sheet P through the feed nip while stripper members 22 prevent the passage of other than the bottom sheet. Upon passing through the feed nip, the sheet P passes through a nip formed by a pinch roller 30 carried on a shaft 32 and an opposing roller (not shown in FIG. 1) mounted on feed roller shaft 20. The sheet P proceeds through this downstream nip between a front guide 24 and respective upper and lower rear guides 26 and 28. As disclosed in the copending application of Richard A. Melcher, Ser. No. 182,482, filed Apr. 15, 1988, the sheet P then passes through an acceleration nip (not shown in FIG. 1) to create a gap between it and any subsequently fed sheet to facilitate counting.

In the feeder 10' shown in FIG. 1, feed rollers 18 and picker rollers 14 are actuated simultaneously. Because of this simultaneous actuation, if the stack S is initially in the condition shown in FIG. 1, with an upper sheet P extending into the feed nip, that sheet will be drawn through the feed nip when the feed members are subsequently actuated. Because the bottom sheet also tends to be driven through the nip upon feed member actuation, misfeed will very likely occur.

Figure 2:
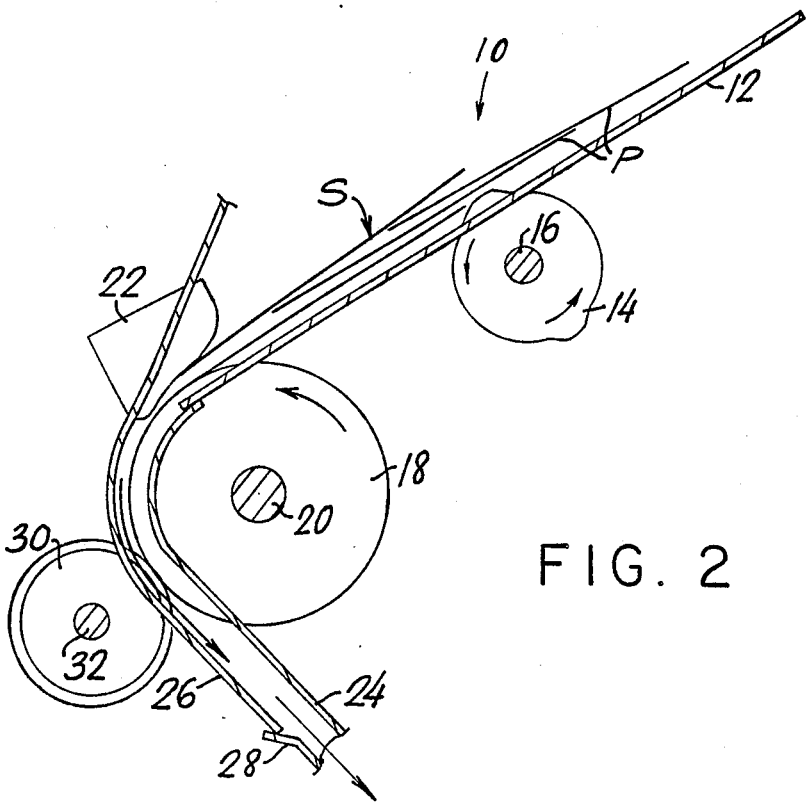
FIG. 2 is a section of a sheet feeder incorporating my preactuated picker roller.
Figure 3:
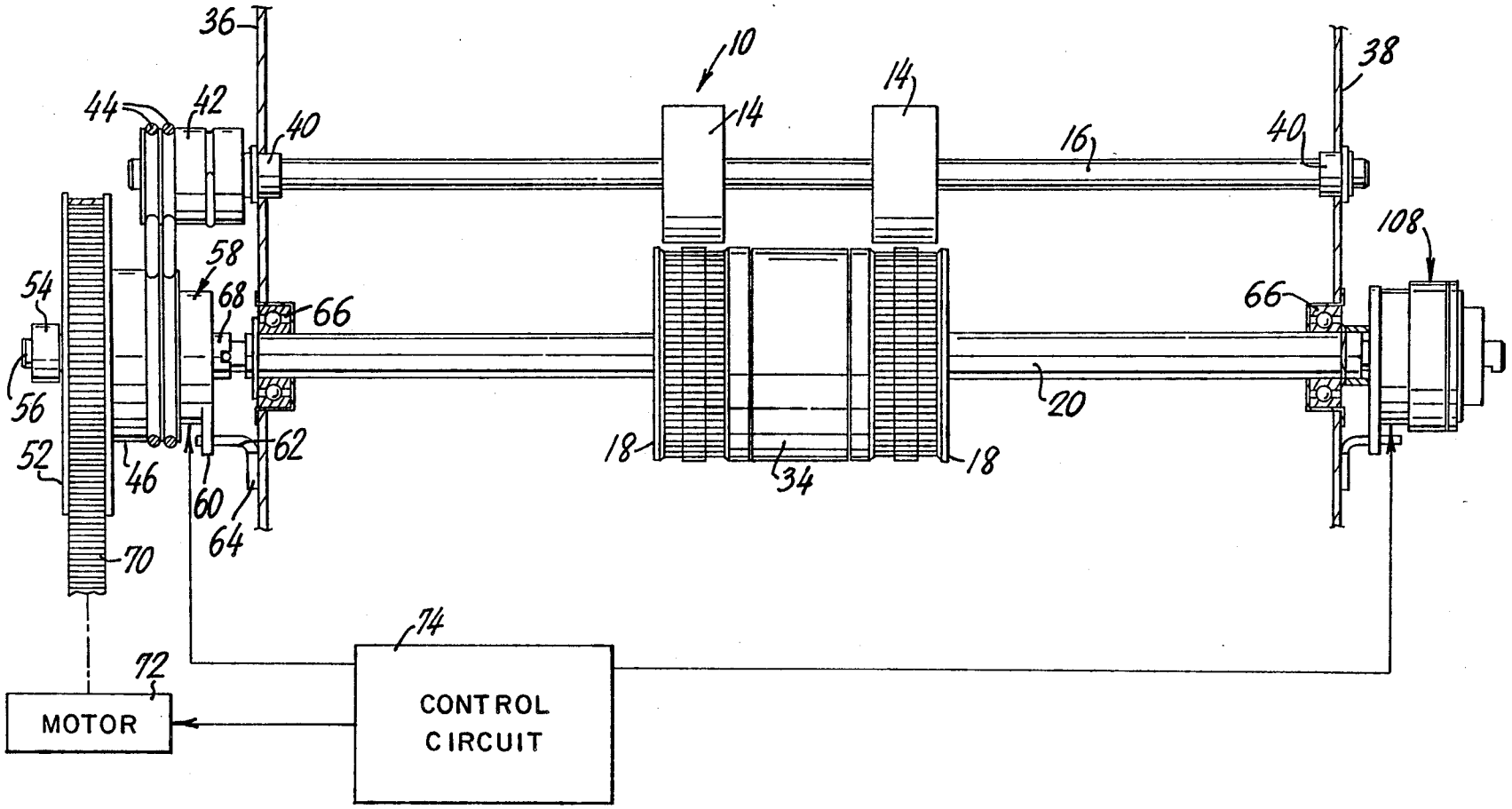
FIG. 3 is a front elevation, with parts shown in section, of the sheet feeder shown in FIG. 2.

Referring now to FIGS. 2 and 3, the sheet feeder of the present invention, indicated generally by the reference numeral 10, is generally similar to the system 10' shown in FIG. 1. In feeder 10, however, picker rollers 14 ar actuated in advance of feed rollers 18 rather than simultaneously as in feeder 10, As a result, picker rollers 14 drive the bottom sheet P into the feed nip formed by feed rollers 18 and stripper members 22, even if another sheet is already at the entrance to the feed nip. That is to say, feed rollers 18, when actuated, grip only the bottom sheet P and drive that sheet through the feed nip, while the stripper members 22 inhibit the passage of additional sheets. Sheet misfeed on start up is thus minimized, even if the sheets P have been carelessly loaded onto the feed tray 12.

Referring now also to FIG. 3, respective bearings 40 support picker roller shaft 16 for rotation relative to left and right side plates 36 and 38, while respective bearings 66 similarly support feed roller shaft 20 for rotation relative to the same side plates. Also shown in FIG. 3 is roller 34, disposed between feed rollers 18 on shaft 20, which cooperates with pinch roller 30 to form the downstream nip referred to above. Shaft 16 carries at its left end a double-groove pulley 42. A pair of 0-ring belts 44 couple pulley 42 to a pulley 46 coaxial with feed roller shaft 20.

Figure 4:
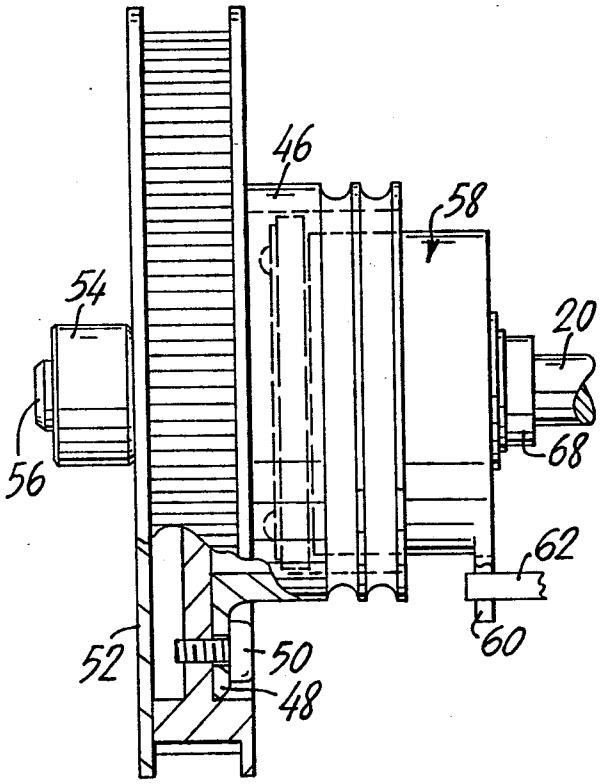
FIG. 4 is an enlarged front elevation of the clutch assembly of the feeder shown in FIGS. 2 and 3, with parts in section.

Referring now also to FIG. 4, pulley 46 is formed with a flange 48 which is secured by means of screws 50 to a timing pulley 52. A collar 54 secures timing pulley 52 to the input member 56 of an electrically actuated clutch 58, the output member 68 of which is coupled to feed roller shaft 20. A slotted prong 60 on the housing of clutch 58 receives a finger 62 of a bracket 64 secured to left side plate 36 to restrain the clutch 58 from rotation. A timing belt 70 (not shown in FIG. 4) couples timing pulley 52 of clutch 58 to an electric motor 72 of any suitable type known to the art. Motor 72 and clutch 58 are actuated by a control circuit indicated generally by the reference numeral 74. Feed roller shaft 20 is also coupled at its right end to an electrically actuated brake 108, which is also coupled to control circuit 74.

Figure 5:
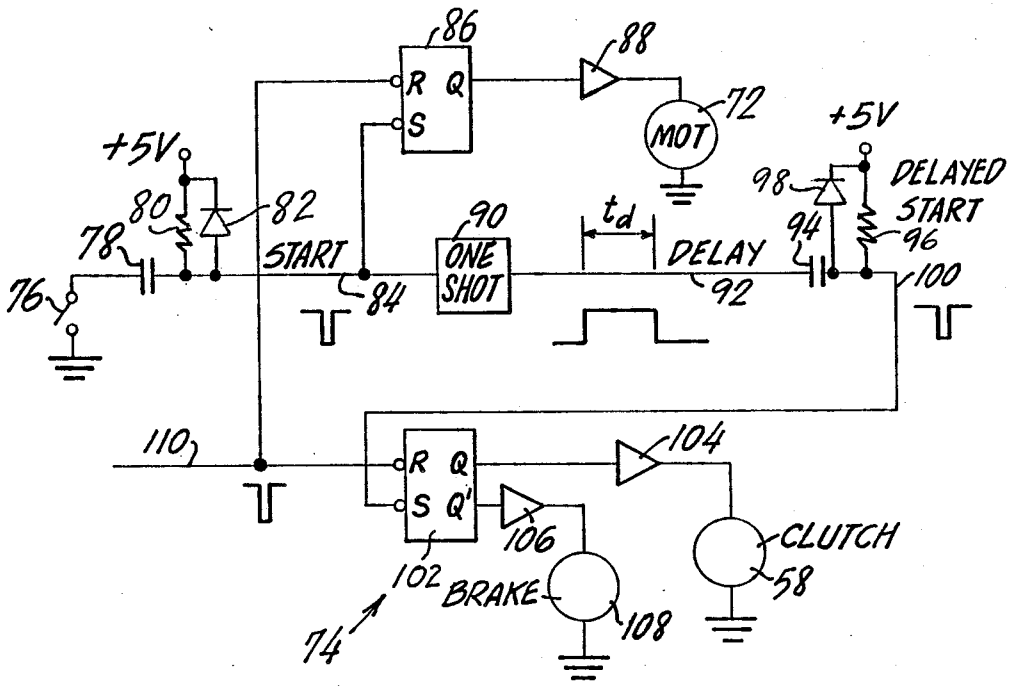
FIG. 5 is a schematic diagram of the control circuit for the eleotromechanical elements of the feeder shown in FIGS. 2 and 3.

Referring now to FIG. 5, in the control circuit 74, a negative-going START pulse is generated on a line 84 by momentarily closing a switch 76. Switch 76 momentarily grounds one terminal of a capacitor 78, the other terminal of which is coupled to line 84. Also coupled to line 84 are a resistor 80 and a diode 82 coupled in parallel to a 5-volt supply. Line 84 is normally at a high logic level, but momentarily changes to a low logic level in response to closure of switch 76 to provide a START signal. This signal is applied to the S input of an RS flip-flop 86 which responds to low-level signals applied to the R and S inputs. Flip-flop 86 initially supplies a low-level output to a driver 88 coupled to motor 72 with the result that motor 72 is off. In response to the START signal, flip-flop 86 supplies a high-level output to driver 88, actuating motor 72.

The START signal on line 84 is also applied to the input of a monostable multivibrator or one-shot circuit 90, which responds by generating a positive-going DELAY pulse on line 92 having a duration $t_d$, which is preferably between about 0.2 second and about 0.5 second and, in particular, is about 0.4 second in the embodiment shown. One-shot circuit 90 has its output coupled to one terminal of a capacitor 94, the other terminal of which is coupled to a resistor 96 coupled to the 5-volt supply and a diode 98 coupled to the 5-volt supply in parallel with resistor 96. In response to the DELAY signal on line 92, a line 100 also coupled to resistor 96 and diode 98 carries a negative-going DELAYED START pulse, which is delayed relative to the START pulse by the delay time $t_d$. This delayed START pulse is supplied to the S input of a second RS flip-flop 102. Flip-flop 102, which is initially reset, has its Q output coupled to a driver 104 actuating clutch 58 and its Q', or inverted Q, output coupled to a driver 106 actuating brake 108.

In operation, generation of a START signal on line 80 by closing switch 76 actuates motor 72 immediately to drive picker rollers 14 and thereby insert the bottom sheet of paper into the feed nip. After the delay interval $t_d$ established by one-shot circuit 90, flip-flop 102 simultaneously deactuates brake 108 and actuates clutch 58 to drive feed rollers 18. When the feeding operation is to be halted, either when a predetermined number of sheets P have been fed from tray 12, in a batching operation, or when all of the sheets have been fed from tray 12, a negative-going STOP signal generated on line 110 by any suitable means is applied to the reset inputs to flip-flops 86 and 102 to deactuate motor 72 and clutch 58 and actuate brake 108. As a result, feed rollers 18 are immediately brought to a halt, while picker rollers 14 and the associated components of the drive train come to a halt shortly thereafter. If desired, a similar delay circuit may be used to delay the resetting of flip-flop 86 until a predetermined period of time has elapsed following the resetting of flip-flop 102. However, resetting both flip-flops simultaneously minimizes the period of time that picker rollers 14 beat against the lowermost sheet P in stack S.

It will be seen that I have accomplished the objects of my invention. My sheet feeder reduces the chances of misfeed and, in particular, minimizes the tendency for other sheets to pass through the feed nip along with the sheet being fed.

It will be understood that certain features and subcombinations are of utility and may be employed without reference to other features and combinations. This is contemplated by and within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Sheet-feeding apparatus including in combination a feed member, means cooperating with said feed member to form a nip, means for supporting a stack of sheets with their edges in said nip, a picker member arranged to engage an end sheet in said stack at a location upstream from said feed member, an electrically actuated clutch having an input and an output, means for driving said clutch input, means for coupling said feed member to said clutch output, and means for coupling said picker member to said driving means independently of said clutch.

2. Apparatus for feeding sheets from an input stack of sheets to an output location including in combination a feed roller, means cooperating with said feed roller to form a nip, means for supporting said input stack of sheets with edges thereof adjacent to said nip, a picker member adapted to engage an end sheet of said stack, drive means adapted to be energized to drive said picker member and said feed roller continuously in the course of a feeding operation to cause said picker member to move sheets from said stack into said nip and to cause said feed roller to move sheets from said nip to said output location, means for energizing said drive means and means responsive to the initial energization of said drive means for delaying the driving of said feed roller.

3. Apparatus as in claim 2 in which said picker member engages said end sheet during only a part of the picker member movement.

4. Apparatus as in claim 2 in which said supporting means supports said stack with said end sheet lowermost.

5. Apparatus as in claim 2 in which said supporting means inclines said stack upwardly away from said nip.

6. Apparatus as in claim 2 in which said delaying means delays the driving of said feed roller for between about 0.2 second and 0.5 second.

7. Apparatus as in claim 6 in which said predetermined period is about 0.4 second.

8. Apparatus as in claim 2 in which said drive means comprises a common prime mover and means coupling said common prime mover directly to said feed roller and in which said delaying means comprises an electrically actuated clutch coupling said prime mover to said picker means.

9. Apparatus for feeding sheets from an input stack to an output location including in combination, a feed roller, a stripper member cooperating with said feed roller to form a nip, means for supporting said input stack on end, a picker member adapted to engage the bottom most sheet in said stack, means for driving said picker member and said feed roller to cause said picker member to move sheets from said stack into said nip and to cause said feed roller to move sheets from said nip to said output location, said drive means comprising an energizable prime mover, means coupling said prime mover directly to said feed roller and a normally disengaged clutch for coupling said prime mover to said picker means, means for energizing said prime mover, and means responsive to initial energization of said prime mover for engaging said clutch after a time delay.

* * * * *